United States Patent [19]

Bettesworth

[11] Patent Number: 4,531,696

[45] Date of Patent: Jul. 30, 1985

[54] KNIFE HOLDER AND CARRYING CASE

[76] Inventor: Lyle J. Bettesworth, Kelso, Wash. 98626

[21] Appl. No.: 375,827

[22] Filed: May 7, 1982

Related U.S. Application Data

[63] Continuation-in-part of Ser. No. 119,530, Feb. 7, 1980.

[51] Int. Cl.[3] ..... A47G 21/14

[52] U.S. Cl. ..... 248/37.3

[58] Field of Search ..... D7/74, 73; 248/37.3, 248/37.6

[56] References Cited

U.S. PATENT DOCUMENTS

| | | | |
|---|---|---|---|
| D. 48,039 | 10/1915 | Niper | D7/73 |
| D. 195,527 | 6/1963 | Gilbert | D7/74 |
| 1,937,424 | 11/1933 | Champlin | D7/74 |
| 2,099,906 | 11/1937 | Reese | D7/74 |
| 2,354,968 | 8/1944 | Pickering | 248/37.3 |
| 3,094,730 | 6/1963 | Schwarz | D7/74 |

OTHER PUBLICATIONS

House and Garden, Oct. 1974, p. 191.

*Primary Examiner*—Reinaldo P. Machado
*Assistant Examiner*—Alvin Chin-Shue
*Attorney, Agent, or Firm*—David L. Garrison

[57] ABSTRACT

A knife support and display block uniquely slotted for accommodating knife blades wherein each blade slot consists of three zones, a guiding zone in which the opposed surfaces forming the slot converge from the top of the support block, a non-yielding throat zone in which the opposed surfaces forming the slot further converge to a slot width at which the surfaces forming the slot can engage and support the side surfaces of a tapered knife blade, preventing further insertion of the knife blade within the slot, and an edge recess zone for receiving the blade edge of the knife without engaging the surfaces defining the edge recess zone, whereby knife blades positioned in said block are securely but removably positioned in a storage location in which the knife edge is protected from damage.

5 Claims, 6 Drawing Figures

Fig. 1.
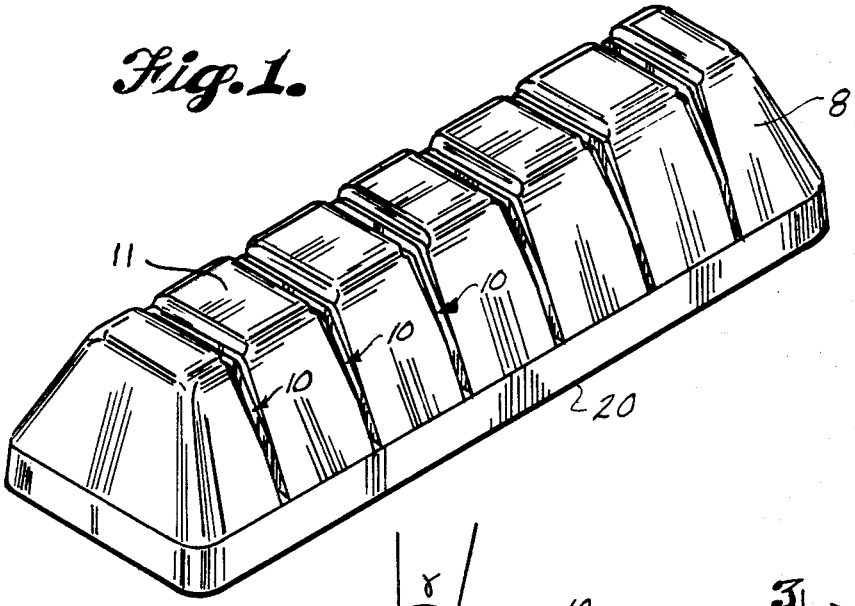
Fig. 2.
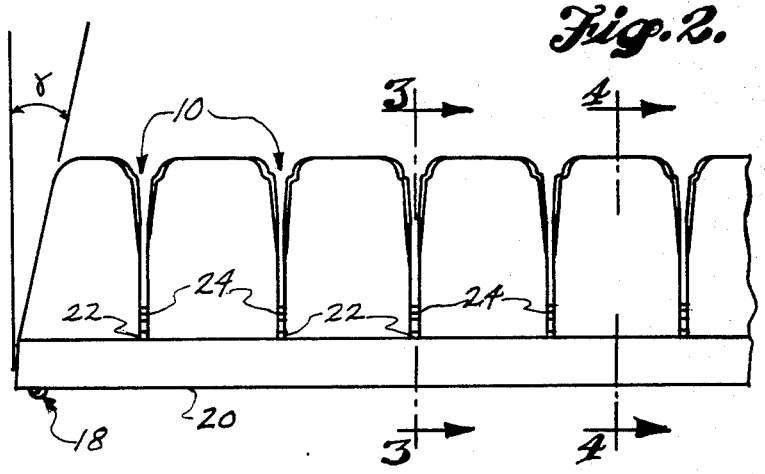
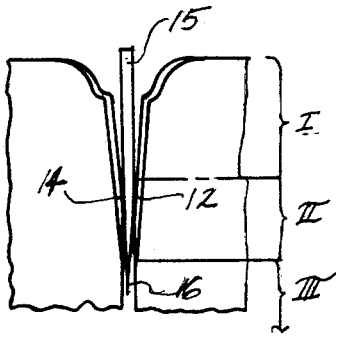
Fig. 5.
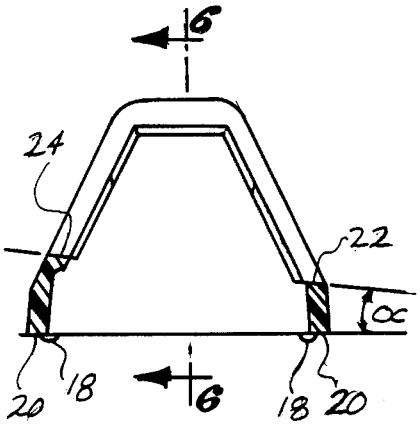
Fig. 3.
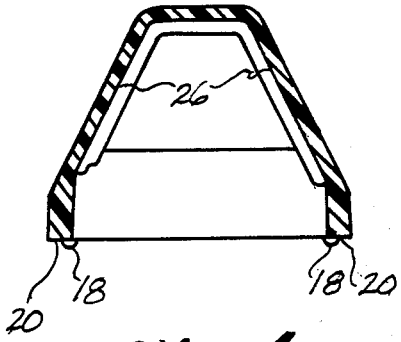
Fig. 4.
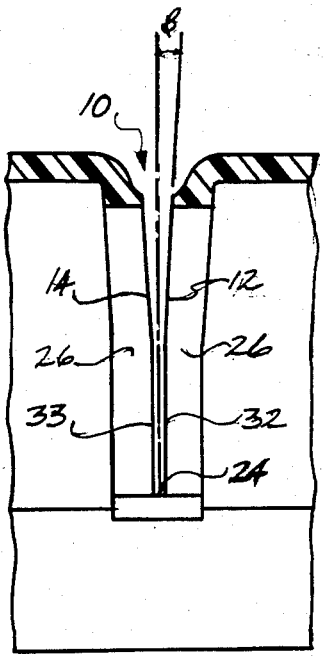
Fig. 6.

KNIFE HOLDER AND CARRYING CASE

This application is a continuation-in-part of my copending application, Ser. No. 119,530 filed Feb. 7, 1980.

BACKGROUND OF THE INVENTION

This invention relates to the field of tool and utensil holders and more particularly to knife holders.

Many different knives with varying shapes and blade thicknesses are used in the preparation of meats and various foods, both commercially and domestically. Carving knives for meat, chopping knives for vegetables, cleavers and bread slicing knives, to name a few, all have different blade cutting edges and blade shape configurations. To prevent damage to the knives and possible injury to users these different knives must be stored and displayed with their cutting edges protected and with a major portion of the blade in view so the knife user can easily select the correct knife.

Knife holders in currect use are versions of several basic types. One of these types is the slotted vertical block, wherein knives are dropped tip first into relatively wide slots cut in a wooden block. The slots of this type of block can accommodate only one size of a knife blade or those knives having smaller blades. Since the slots are closed except at the top, this type of knife holder is difficult to clean and dry and does not display the knife blades for easy selection by the user.

Other knife holders consist basically of a support block having a series of wide slots cut therein which partially bisect the block. In this type of knife holder the weight of the knife rests on the knife edge which sits on the bottom of one of the slots. The knife blade can be dulled by repeated contact with the bottom of the slot and in addition, the knife blade cuts into the support block and eventually destroys the block after extended usage.

OBJECTS OF THE INVENTION

It is an object of this invention to provide a knife support and display block means in which knives may be securely but removably positioned with the cutting edge thereof protected and out of contact with the block.

It is a further object of this invention to provide a knife support and display block means having knife support elements which unyieldingly engage the sides of the knife blade remote from the sharpened edge preventing further insertion of the knife blade into the block.

It is a still further object of this invention to provide a knife support and display block means having a plurality of knife holding slots, which block accomodates knives having various blade thicknesses and widths while securely supporting the knife blades in a location so that the sharpened edge does not come into contact with the base of the slots.

SUMMARY OF THE INVENTION

This invention provides a slotted knife support and display block for substantially horizontal, blade down, support of knives in which the opposed unyielding surfaces forming the slots converge from the top of the block to a knife side surface engaging zone which grips the sides of a knife to prevent further insertion so that the knife, when positioned edge first in the slot assumes a position with its side surfaces unyieldingly gripped by the converging opposed surfaces with the cutting edge of the blade suspended above the base of the slot.

Each slot has three characteristic width zones; a guiding zone, having sides converging downwardly, a throat zone for receiving and unyieldingly gripping the blade, and an edge recess zone for receiving the sharp blade of the knife without engagement thereon upon the surfaces defining the blade edge recess zone.

The knife blade is deposited downwardly, cutting edge first, into the knife support and display block. The convergence of the guiding slot zone guides the blade into a throat zone, which throat converges to the narrow most part of the slot. When the blade has dropped through the throat as far as the widths of the blade and throat will allow, the side surfaces of the knife will be engaged and supported by the unyielding opposed sides of the throat zone, and the blade edge will be suspended in the blade edge recess zone, prevented from further insertion with the edge out of contact with any block surface.

The slots are preferably positioned perpendicular to the support surface but may advantageously be canted to display more of the blade configuration for ease of selection by the knife user.

The knife support and display block of this invention is utilized in the support and display of knives in, for example, a drawer or other substantially horizontal support surface and is removable secured to the substantially horizontal portion of the drawer or support surface. The block is constructed of a material which is readily cleaned, such as a hard wood, plastic, metal or other suitable hard, unyielding material. Preferably, the block is injection-molded form a dishwaster-safe plastic material so that the block may simply be removed from its support location and inserted into a dishwasher for cleaning and sterilizing. The tapered slots taught herein for knife support and display are readily cleaned inasmuch as full access to the slot is permitted by the downwardly converging nature of the slot. The slots cut into the knife holding block are preferably canted with respect to the support surface to fully engage a knife placed in the slot having the knife handle resting on and supported by the support surface.

BRIEF DESCRIPTION OF THE DRAWINGS

FIG. 1 is a perspective view of the device of this invention.

FIG. 2 is a partial side elevational view of the apparatus shown in FIG. 1.

FIG. 3 is a cross-sectional view of the apparatus shown in FIG. 2 taken along lines 3—3.

FIG. 4 is a cross-sectional view of the apparatus shown in FIG. 2 taken along lines 4—4.

FIG. 5 is a partial side elvational view of the apparatus shown in FIG. 1, greatly enlarged to show details of the slot with a knife blade positioned therein.

FIG. 6 is an enlarged partial cross-sectional view of the apparatus shown in FIG. 3 taken along lines 6—6 thereof.

DETAILED DESCRIPTION OF THE PREFERRED EMBODIMENT

Referring specifically to the drawings wherein like figures indicate like parts, there is seen in FIG. 1 a perspective view of one embodiment of the knife holder apparatus of this invention. The apparatus shown comprises an essentially hollow, molded block means, generally triangular in cross section, which has a plurality of knife-receiving slot means 10 extending downwardly from the truncated top surface 11 of the block. The slots 10 formed in the block are shown substantially perpendicular to the block support surface and converge downwardly from the top of the block to a narrow, bladereceiving zone as is best shown in FIGS. 5 and 6. The upper zone I is widened to guide and receive the blade of the knife and to begin orientation of the blade into its rest position. Zone II is a continuing converging area of the slot wherein the unyielding sides 12 and 14 approach each other to engage, position and support the sides of a knife blade inserted therein as is seen in FIG. 5, preventing further travel of the knife into the slot. Zone III is a blade edge receiving zone wherein the sharpened edge of the blade is suspended when the sides of the blade are gripped by sides 12 and 14 of the slot 10. Thus, as is seen in FIGS. 5 and 6, the sharpened edge 16 of blade 15 does not contact the side edges 12 and 14 or the bottoms 22 and 24 of the slot but rather is suspended in a protected position since the blade cannot be inserted further into the slot.

In FIG. 2 a side elevational view of a portion of the apparatus is shown. End surfaces of the device are shown slanted in an an angle $\gamma$ in the preferred embodiment. Embossed feet 18 are shown extending downwardly from the bottom surface 20 of the block 8.

As is best seen in FIG. 3, the unyielding contact zones or locations at which the side surfaces of the knife blades are contacted by the side surfaces of the slot, differ in height to accommodate knives angled with their handle resting on the support surface, such as a drawer bottom, and their blades inserted into the slots of the holder. The bottoms 22 and 24 of slots 10 are shown positioned on a line angling upwardly from the horizontal at an angle $\alpha$. The blade contact locations are positioned above the bottoms 22 and 24 of slot 10 and lie on a line angling upwardly at an angle $\alpha$ from the horizontal so that the slot is canted with respect to the horizontal support surface. In practice, it has been found that the angle $\alpha$ may vary from about 3° to approximately 10° depending on the length and configuration of the knives being stored in the device. In the embodiment shown the angle $\alpha$ is approximately 6°. Canting the slot in this manner permits full unyielding support of the blade on both sides of the slot with the handle of the knife resting on the support surface.

In FIG. 4 a cross-sectional view of the device taken along lines 4—4 of FIG. 2 shows the interior embossments 26 which provide additional strength and gripping surface for the slots 10. That is, the bearing surface 12 and 14 of the slots 10 are enlarged due to the inclusion of embossments 26 so that the unyielding nature of the sides 12 and 14 is enhanced to positively prevent excessive insertion of the knife blade into the slot.

An enlargement of the slot area itself is shown in FIG. 6. FIG. 6 is a cross-sectional view of the device shown in FIG. 3 taken along lines 3—3 and which shows from the interior of the device the embossments 26, the slot 10 which is formed with an angle between the converging sides of slot 10 in the upper portion thereof. The lower portion thereof has sides 32 and 33 which are substantially parallel and form the sharpened blade edge receiving zone III as shown in FIG. 5. The angle $\beta$ on the rearward positioned portion of the slot 10 will, of course, exceed the angle $\beta$ on the front of the device so that the contact positions and base of the slot 10 are located as shown in FIG. 3, being in planes angled upwardly at the angle $\alpha$. The ends of the block are preferably angled at an angle $\gamma$ from the vertical.

The device shown in the figures is preferably constructed of a relatively hard, injection molded plastic such as nylon, acrylonitryl butadiene styrene (ABS), polyethylene, polystyrene, or other suitable hard, strong, light and readily molded plastic. It is desirable that plastic be able to withstand the environment of a dishwasher so that the device may be readily cleaned. Metal or wood may, of course, be used.

While the device of this invention has been shown and described with respect to a specific embodiment, it is clear that minor modifications and changes well within the scope of this invention can be envisioned without departing from the scope and spirit hereof. For example, other materials may be substituted for the described materials since the specific materials do not form a part of the inventive contribution. The specific configuration of the slot may be varied to include other configurations which provide a blade-receiving slot with converging slot sides to grip the side surfaces of the knife blade. An enlarged zone for receiving the sharpened knife blade edge could be provided and other configurations of the converging guiding area above the blade gripping portion could be used, all of which are readily apparent to one of ordinary skill in the art.

I claim:

1. A knife support and display apparatus for storing and holding a knife above a support surface comprising:

a supporting block means adapted to engage and extend upwardly from a support surface, said block means having a top surface with a plurality of slots opening upwardly there through, said slots adapted to guide entry, engage and support the blade of a knife inserted therein, said slots having substantially rigid, opposed surfaces shaped to form:

(a) an entrance opening extending from the top of said block means and defined by sloping walls oriented in planes positioned at a first larger angle from the vertical whereby a knife blade may be guided into the slots;

(b) a throat zone below said entrance opening wherein said opposed surfaces of said slots converge at a second, smaller angle from the vertical to form an unyielding, knife blade engaging support; and (c) an edge recess zone downwardly adjacent to said throat zone extending downwardly a depth sufficient to allow a sharpened knife edge to extend thereinto without contacting any surface while said knife is securely engaged and supported by said knife blade engaging support.

2. The apparatus of claim 1 wherein said supporting block is substantially triangular in cross section.

3. The apparatus of claim 1 wherein said slot means are canted with respect to said support surface.

4. The apparatus of claim 1 wherein said block means is hollow.

5. The apparatus of claim 1 wherein said slot means lie generally in a plane positioned substantially perpendicular to said support surface.

* * * * *